US005343565A

United States Patent [19]

Berni

[11] Patent Number: 5,343,565

[45] Date of Patent: Sep. 6, 1994

[54] CLOTHING, IN PARTICULAR FOR COOKS

[76] Inventor: Bruno Berni, Haus Mura, CH-7132 Vals, Switzerland

[21] Appl. No.: 809,284

[22] Filed: Nov. 29, 1991

[30] Foreign Application Priority Data

Mar. 29, 1990 [CH] Switzerland ..... 1041/90-4

[51] Int. Cl.[5] ..... A41D 1/06

[52] U.S. Cl. ..... 2/79; 2/48; 2/46; 2/51

[58] Field of Search ..... 2/79, 48, 47, 46, 51, 2/69, 69.5, DIG. 6, 227, 105, 108, 115, 114, 74, 75, 80, 228, 148, 50, 52, 144

[56] References Cited

U.S. PATENT DOCUMENTS

| | | | |
|---|---|---|---|
| 1,037,206 | 9/1912 | Clifford | 2/51 |
| 1,134,643 | 4/1915 | Sinclair | 2/46 |
| 1,238,770 | 9/1917 | Hostetler et al. | 2/79 |
| 1,405,694 | 2/1922 | Talianoff | 2/75 |
| 1,602,235 | 10/1926 | Maril | 2/79 |
| 1,731,137 | 10/1929 | Jones | 2/74 |
| 1,749,167 | 3/1930 | Swanstrom | 2/79 |
| 1,821,185 | 9/1931 | Luery | 2/74 |
| 1,932,940 | 10/1933 | Sipe | 2/74 |
| 1,967,369 | 7/1934 | Repitsky | 2/74 |
| 2,721,326 | 10/1955 | Williamson | 2/79 |
| 3,004,315 | 10/1961 | Masure | 2/51 |
| 3,428,962 | 2/1969 | Slimovitz | 2/51 |
| 3,727,238 | 4/1973 | Wolfson | 2/47 |
| 3,760,461 | 9/1973 | Wright | 2/DIG. 6 |
| 3,984,876 | 10/1976 | Sutton . | |
| 4,446,573 | 5/1984 | Green | 2/252 |
| 4,639,946 | 2/1987 | Koenig | 2/DIG. 6 |
| 4,754,500 | 7/1988 | Baucato et al. | 2/105 |
| 4,768,236 | 9/1988 | Klob | 2/DIG. 6 |
| 4,987,610 | 1/1991 | Hunt | 2/46 |

FOREIGN PATENT DOCUMENTS

| | | | |
|---|---|---|---|
| 8034173 | 6/1982 | Fed. Rep. of Germany . | |
| 1032364 | 7/1953 | France | 2/79 |
| 2399783 | 3/1979 | France . | |
| 4357 | of 1890 | United Kingdom | 2/148 |
| 014615 | of 1914 | United Kingdom . | |
| 178240 | of 1922 | United Kingdom . | |

*Primary Examiner*—Clifford D. Crowder
*Assistant Examiner*—Gloria Hale
*Attorney, Agent, or Firm*—Horst M. Kasper

[57] ABSTRACT

To protect cooks, who work alternately in hot and cold rooms, from catching colds, to prevent clothing from slipping during work, to allow clothes to be donned simply and easily, and to preserve a well-groomed appearance, the clothing consists of trousers (8) and a jacket (1), which together form an overall or a jump suit. A zip fastener (7) extends from the fly (8') of the trousers up to the collar of the jacket (1). The clothing is associated with an apron (11) with fiat strip fastener parts (9') and a neck band (13) with a tie knot (14).

19 Claims, 15 Drawing Sheets

FIG. 2
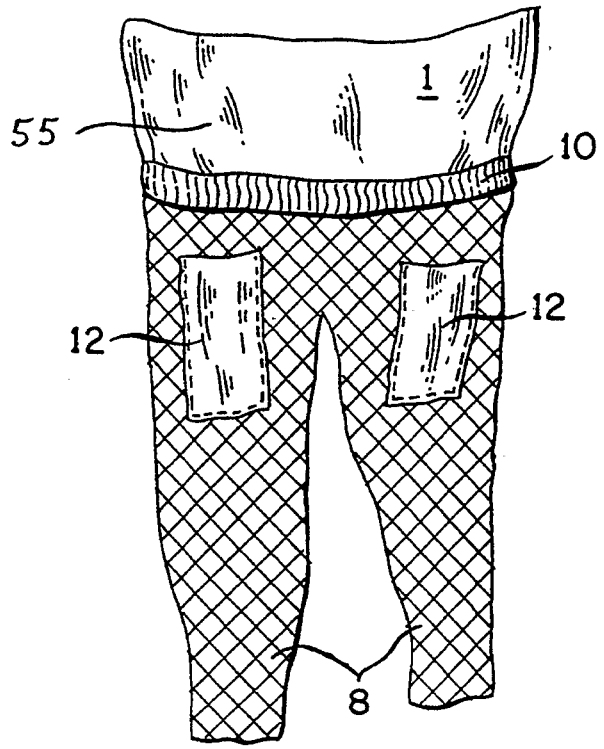
FIG. 4
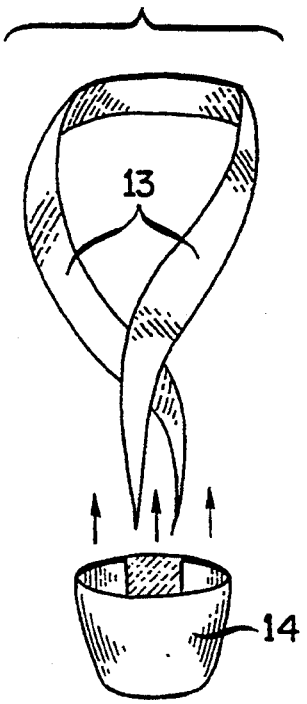
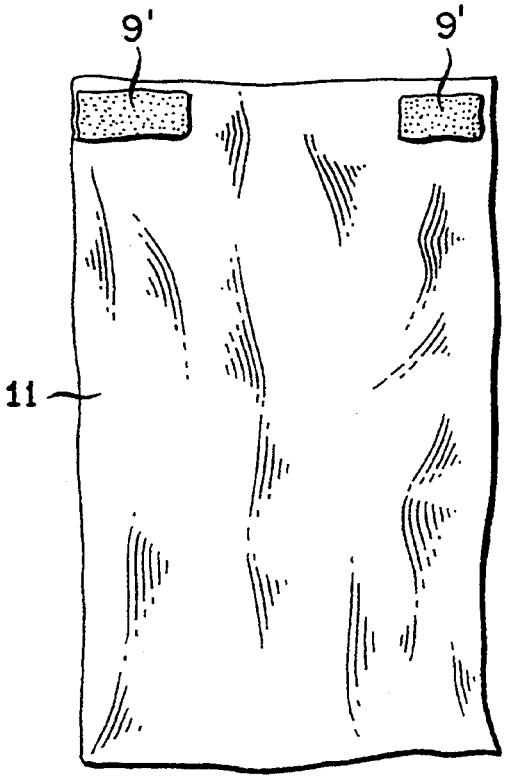
FIG. 3

CLOTHING, IN PARTICULAR FOR COOKS

CROSS-REFERENCE TO RELATED APPLICATIONS

This application is a continuation-in-part application of another international application filed under the Patent Cooperation Treaty Mar. 26, 1991, bearing Application No. PCT/CH91/00072, and listing the United States as a designated and/or elected country. The entire disclosure of this latter application, including the drawings thereof, is hereby incorporated in this application as if fully set forth herein.

BACKGROUND OF THE INVENTION

1. Field of the Invention

The present invention relates to clothing, in particular for cooks, formed as a combination of and including a pair of trousers and a jacket.

2. Brief Description of the Background of the Invention Including Prior Art

Traditional clothing for cooks comprises in general several separate parts, such as a jacket with a button closure, a pair of trousers with suspenders or with a belt, and an apron. The buttoning of the jacket is often cumbersome and the frequent insertion of tile buttons into the receiving slits of the jackets stretches and enlarges the receiving slits prematurely. This can result in an undesired opening of the jacket and can endanger the wearer of the jacket or make the wearer uncomfortable.

The conventional, coordinated aprons are tied by strings on or above the level of the hips of the wearer or, respectively, of the cook. The relatively weak strings are however easily ripped due to frequent use and are in many cases completely torn from the apron after some use of the apron.

Based on the repeatedly occurring bending motion during work, the conventional clothing pieces for cooks become loose, the desired property of a tight fit on the human body is lost, and the air access obtains free rein to the undergarments or the body of the person. This can result in health hazards in cases where the wearer of such conventional clothing moves from hot work places into cooled rooms, in particular into freezer chambers where e.g. temperatures below −18° C. are present.

SUMMARY OF THE INVENTION

Purposes of the Invention

It is an object of the present invention to provide clothing in particular for cooks, which clothing retains tight-fitting properties relative to the wearer and assures thereby a protection for the wearer against catching colds, if work is performed alternatingly in hot, cool, cold, windy, or deep-freeze chambers.

It is another object of the present invention to furnish cooks with clothing which allow a comfortable donning and wearing as well as a well-groomed appearance.

These and other objects and advantages of the present invention will become evident from the description which follows.

Brief Description of the Invention

The present invention provides for a jump suit having a jacket with a collar. A pair of trousers having a fly and forming a waist band in the area of the waist is sewn onto the jacket in the area of the waist. A zip fastener is attached to the trousers and extends from the fly over the waist band of the trousers toward the collar of the jacket. Hook and loop fasteners are disposed at least at two sides, located opposite to each other, at the waist band of the trousers. An apron is provided with hook and loop counter parts matching substantially the flat strip hook and loop fasteners in their position for detachable attachment at said hook and loop fasteners. The jacket can be white.

The apron can exhibit the hook and loop counter parts in the region of its waist band region, disposed opposite to the waist band of the trousers, on both sides of the apron. A hem can have a covering position and can be furnished in the same region of the apron as corresponds to the waist band for covering one of the hook and loop counter parts disposed on one side of the apron. The hem can be fixed for remaining in the covering position. The hem of the apron can be fixed in the covering position at its narrow edges located at the apron by attachment elements furnished at the apron. The attachment elements can be furnished by dome snap fasteners at the apron.

The trousers can be furnished with a white/black checker pattern and the jacket can be made of a white fabric.

A tie knot can be provided where the rear side of the tie knot can be formed of an elastic band. The tie knot can be separate and is not permanently attached to the jacket. A neck band having two ends can be coordinated to the jacket but is not permanently attached to the jacket. The ends of the neck band can be pulled through the separate tie knot.

The zip fastener can run upwardly in the area or the fly up to about the navel area of the person wearing the jump suit. The zip fastener can be running at an angle to from about the navel area to one side of the neck of the person.

The chest part of the jacket can be furnished with a shirt part extending from the zip fastener substantially symmetrically in front of the person covered with a jacket section. Buttons can be disposed in two vertical rows and attached to the shirt part and can adorn said shirt part.

The covering jacket section can be lined vertically in the middle and can be furnished with slits for the buttons attached to the shirt part. The buttons can engage the slits on the covering jacket section.

Pockets can De formed at the trousers. Hook and loop fasteners can be furnished at the pockets of the trousers.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

In the accompanying drawings, in which are shown several of the various possible embodiments of the present invention:

FIG. 2 illustrates a partial rear side view of the jacket and the pair of trousers of FIG. 1;

FIG. 3 illustrates a rear view of an apron;

FIG. 4 illustrates a neck band and a tie Knot coordinated to the clothing;

DESCRIPTION OF INVENTION AND PREFERRED EMBODIMENT

Figure 1:
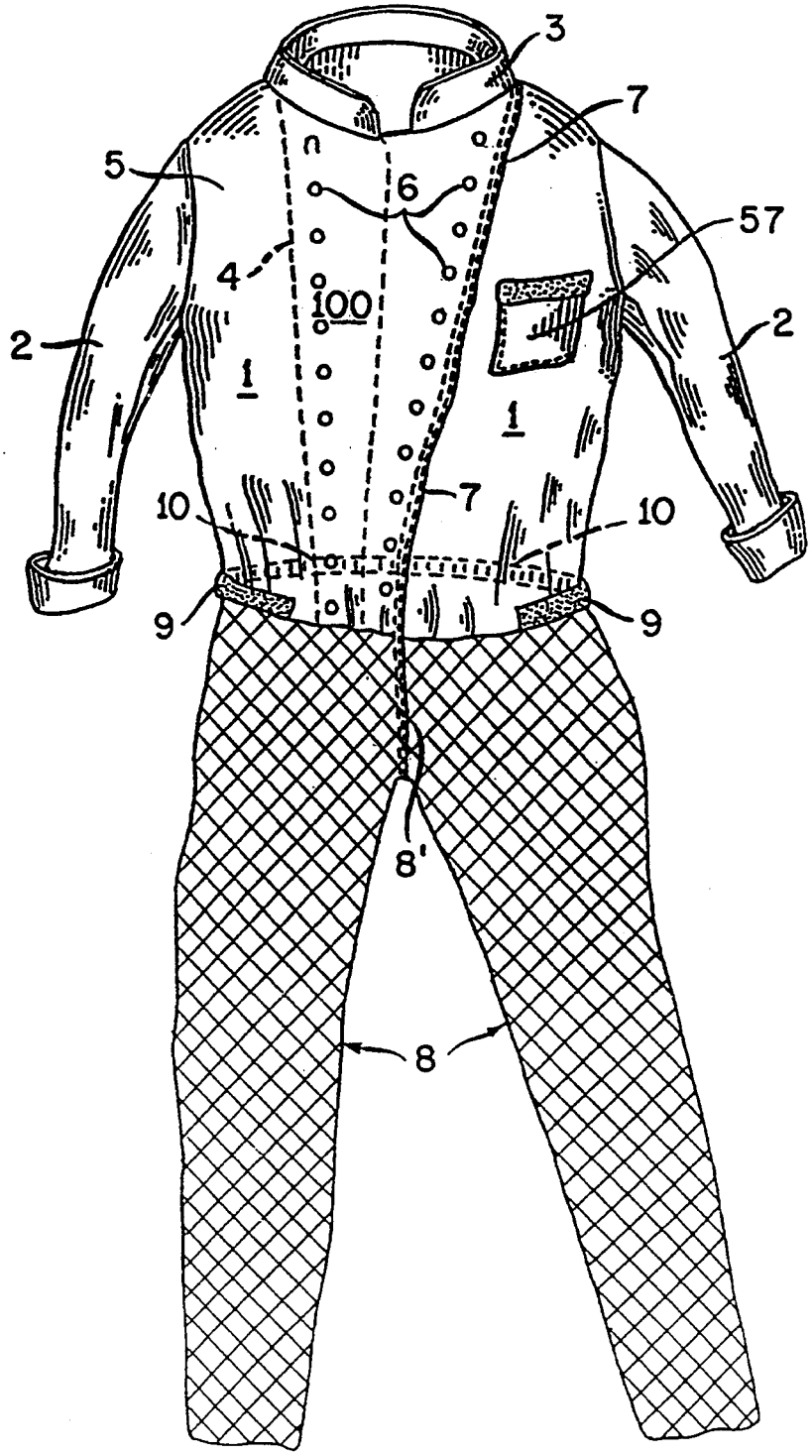
FIG. 1 illustrates a front view of combination clothing comprising a jacket and a pair of trousers.

According to the present invention there is provided for clothing, in particular for cooks. A pair of trousers 8 is sewn onto a white jacket 1. The trousers 8 are furnished with a zip fastener 7, extending from a fly 8' over the waist band of the trousers toward the collar 3 of the jacket 1. Hook and loop fasteners 9 are disposed at least at two sides, disposed opposite to each other, at the waist band of the trousers. An apron, provided with hook and loop fastener 9', is detachably attached at said hook and loop fasteners 9.

The apron 11 can exhibit the hook and loop fasteners 9' in the region of its waist band region, disposed opposite to the waist band of the trousers, on both sides of the apron 11. A hem or cuff can be furnished in the same region for covering a hook and loop fastener 9' disposed on one side of the apron. The hem or cuff can be fixed in every one of the covering positions.

The hem of the apron 11 can be fixed in the covering positions at its narrow edges at the apron by attachment elements, in particular dome snap fasteners.

The trousers 8 can be furnished with a white/black checker pattern and that the part forming the jacket 1 comprises a white fabric.

A neck band 13 can be coordinated to the jacket 1 independent of the jacket 1, where the ends of the neck band 13 can be pulled through a separate tie knot 14. The rear side of the tie knot 14 can be comprised of an elastic band.

Hook and loop fasteners can be furnished at the pockets 12 of the trousers 8.

The invention combination clothing includes a jacket 1 and a pair of trousers 8 and resembles a jump suit. The jacket 1 comprises a neck collar 3, a chest part 5, a back part 55, and two sleeves 2. The chest part 5 is attached on the inner side of the jacket 1 by way of a seam 4. The chest part 5 is furnished with buttons 6 adorning the front side of the jacket 1. The chest part 5 can be directly attached to the jacket 1 with the exception of the area defined approximately by the buttons 6. A patch pocket 57 can be furnished on the jacket in the area outside of the buttons.

A zipper 7 extends from the neck collar 3 of the jacket 1 to the fly 8' of the trousers 8. The neck collar 3 can be a stand-up collar or a turtle-neck collar. The zipper is preferably extending substantially as a straight line from a side of the neck to a middle position in the area of the navel of the person and as a straight line from the area of the navel in a downward direction. The zipper 7 is furnished with two conventional sliders, not illustrated in detail, such that the sliders allow an opening from both an upper end and a lower end of the zipper 7.

A hook and loop, VELCRO-type strip fastener attaches two textile strips to each other with a plurality of small hooks distributed over the surface. As desired, one of the strips to be attached or both of the strips to be attached can be furnished with the plurality of hooks, possibly substantially uniformly distributed over the respective strip. Hook and loop fasteners 9 are placed in the transition region of the trousers to the jacket 1 at the front side of the jacket 1 for forming Velcro-type fastener connections. Each hook and look fastener 9 has a width of from about 2–3 cm and a length of from about 6–8 cm.

An elastic band 10 is disposed at the back side part of the combination clothing piece or, respectively, of the jacket 1 at the level of the waist band of the trousers 8 between the two hook and loop fasteners 9. Said elastic band 10 nestles against and can acts as a waist band of the trousers in the region of the hips. The elastic band 10 allows a retaining of the trousers on the wearer or, respectively, on the cook without requiring a presence of a special belt.

An apron 11 made of a fabric or plastic is furnished at its upper side with two hook and loop fasteners 9', wherein the parts are disposed at a distance from each other. The flat zip fastener parts or hook and loop fasteners 9' are designated to be applied to the flat zip fastener parts or hook and loop fasteners 9 disposed at the jacket 1. In particular, at least two flat zip fastener parts 9' are disposed in the region of the apron 11, wherein the apron 11 is brought to be placed against the waist strip of the trousers 8 on both sides of the apron 11, i.e. at the outer side and at the inner side of the apron 11. The apron 11 exhibits a hem furnished adjoining to the waist band region, which hem has a width corresponding approximately to the width of the waist band, and which hem covers in its folded-over position in each case the hook and loop fastener 9′ on one of the apron sizes. This hem is preferably connected at its free corners of its narrow sides with a short seam to the apron 11, such that the hem or cuff is retained and maintained such as it were in its folded-over position. It is however also possible to hold this hem or cuff with fastening elements, for example, dome snap fastener pairs, in the respective folded-over position.

Figure 6:
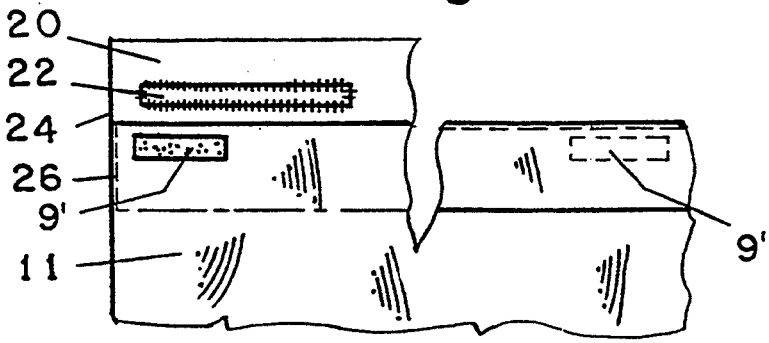
FIG. 6 illustrates a front view of an apron including a hem in a second embodiment.

A second embodiment of the apron 11 is illustrated in FIG. 6. A hem 20 can be formed at the apron 11 by folding over the top edge of the apron 11, where the folded-over portion corresponds approximately to the width of the waist band. The hem 20 is only sewn at its free corners of the apron 11. Before sewing the narrow sides 24 to the sides 26 of the apron 11 to form the hem 20, two hook and loop fasteners 9′ are attached to the uppermost region of a first side of the apron 11 and the two hook and loop fasteners 9′ are spaced at a distance from each other such that said distance corresponds to the distance between the hook and loop fasteners 9 attached on the combination clothing. The hem 20 covers in its folded-over position in each case the hook and loop fasteners 9′ on the first side of the apron 11. In the folded-over position of the hem 20, two additional hook and loop fasteners 9′ are attached to the uppermost region of a second side of the apron 11, and the two additional hook and loop fasteners 9′ are spaced at a distance from each other such that said distance corresponds to the distance between the hook and loop fasteners 9 attached to the combination clothing. Regardless of whether the hem 20 is folded to the first side of the apron or to the second side of the apron 11, the snort seam, formed by sewing the narrow sides 24 of the hem 20 to the side 26 of the apron, keeps the hem 20 at all times in its folded-over position. It is however also possible to hold this hem 20 with fastening elements, for example, dome snap fastener pairs, in the respective folded-over position.

A slit 22 can be cut into the folded-over portion of the hem 20. The slit 22 is reinforced all around its edges so as to avoid a fraying of the material. Said slit 22 can for example serve as an aperture through which a rag or washcloth can be inserted.

Figure 5:
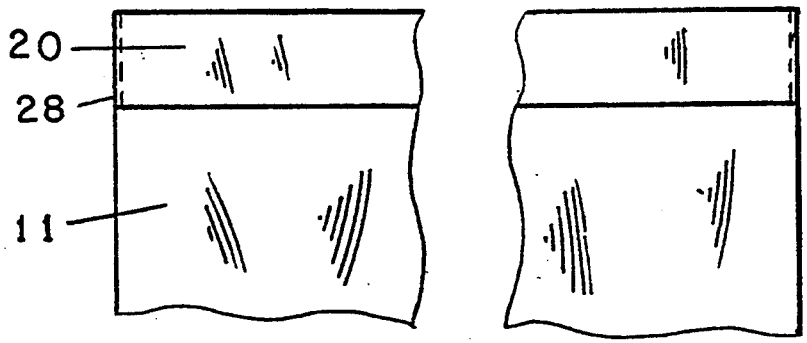
FIG. 5 illustrates a front view of an apron including a hem in a first embodiment.

A third embodiment of the apron 11 is illustrated in FIG. 5. This embodiment is similar to that of FIG. 6 in that a possibility is provided for insertion of a rag. However, instead of folding over the upper portion of the apron 11 to form a hem 20, a separate fabric band 28, having a width corresponding approximately to the width of the waist band, is attached by its two ends to the side seams of the uppermost portion of a first side of the apron 11.

Before sewing the fabric band 28 to the side sections 26 of the apron 11 to form a kind of a loop for inserting a washcloth or a rag, two hook and loop fasteners 9′ are attached to the uppermost region of a first side of the apron 11 and the two hook and loop fasteners 9′ are spaced at a distance from each other such that said distance corresponds to the distance between the hook and loop fasteners 9 attached on the combination clothing. The fabric band 28 covers the hook and loop fasteners 9′ on the first side of the apron 11. Two additional hook and loop fasteners 9′ are attached to the uppermost region of a second side of the apron 11, and the two additional hook and loop fasteners 9′ are spaced at a distance from each other such that said distance corresponds to the distance between the hook and loop fasteners 9 attached to the combination clothing. Regardless of whether the fabric band 28 is disposed on the first side of the apron or on the second side of the apron 11, the fabric 28 forms a loop since only the ends of the fabric band 28 are attached to the sides 26 of the apron 11. It is however also possible to fasten this fabric band 28 to a respective side of the apron 11 by means of fastening elements, for example, dome snap fastener pairs.

As illustrated in FIG. 2, pockets 12 can be furnished at the back side of the trousers 8. Said pockets 12 can be expediently closed in a conventional way by buttons or by applied attachment closure parts.

A neck band 13 is coordinated to the combination clothing and can be placed around the neck of the wearer or, respectively, the cook. The neck band 13 can be closed with a separate tie knot 14, as illustrated in FIG. 4.

Figure 7:
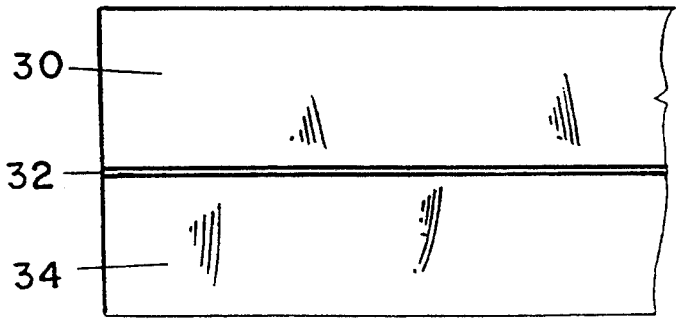
FIG. 7 illustrates a strip fastener closure with protection flap to be sewn onto combination clothing of trousers and jacket.
Figure 8:
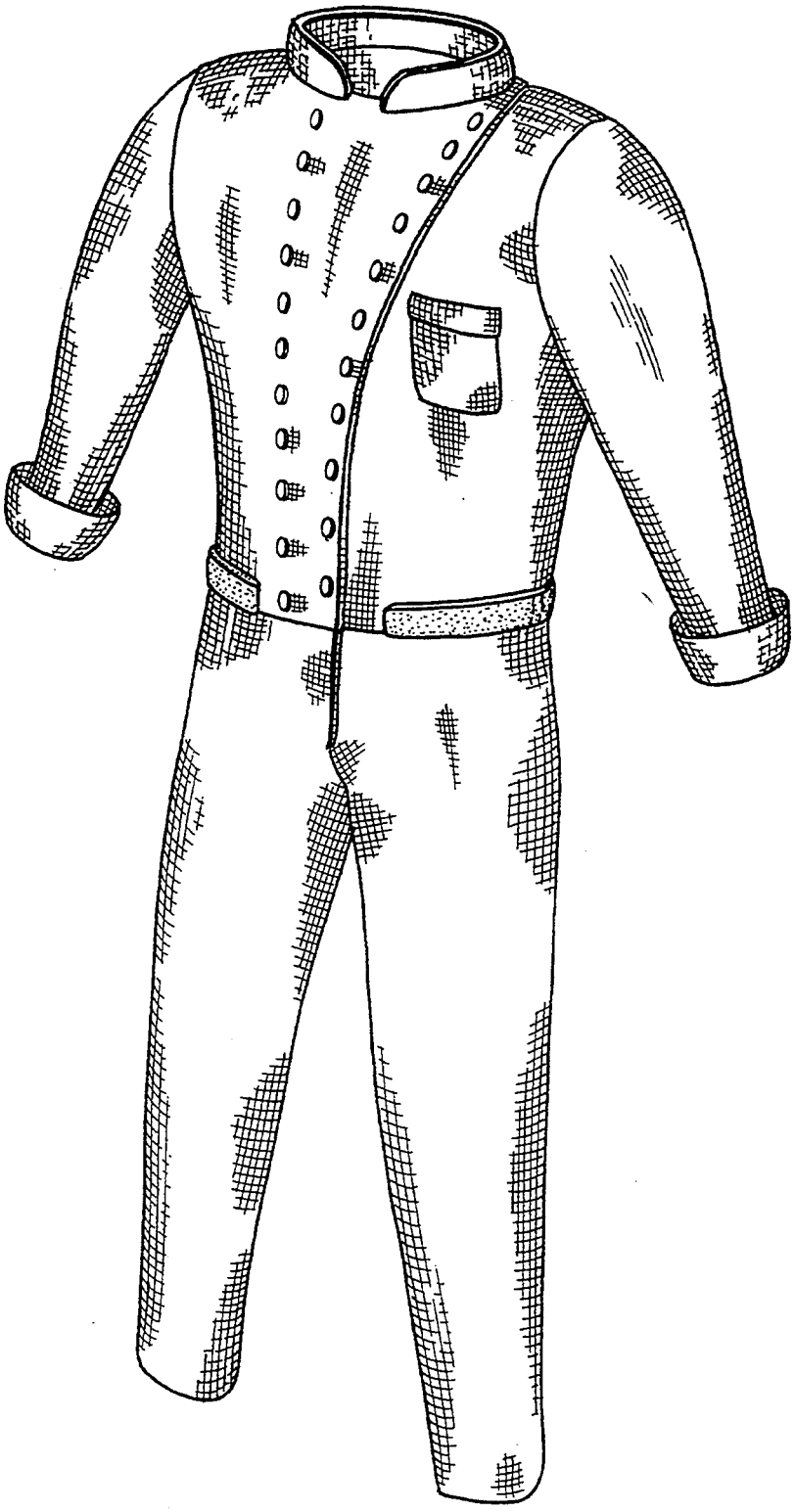
FIG. 8 illustrates an angular front view of the combination clothing including trousers and jacket.
Figure 9:
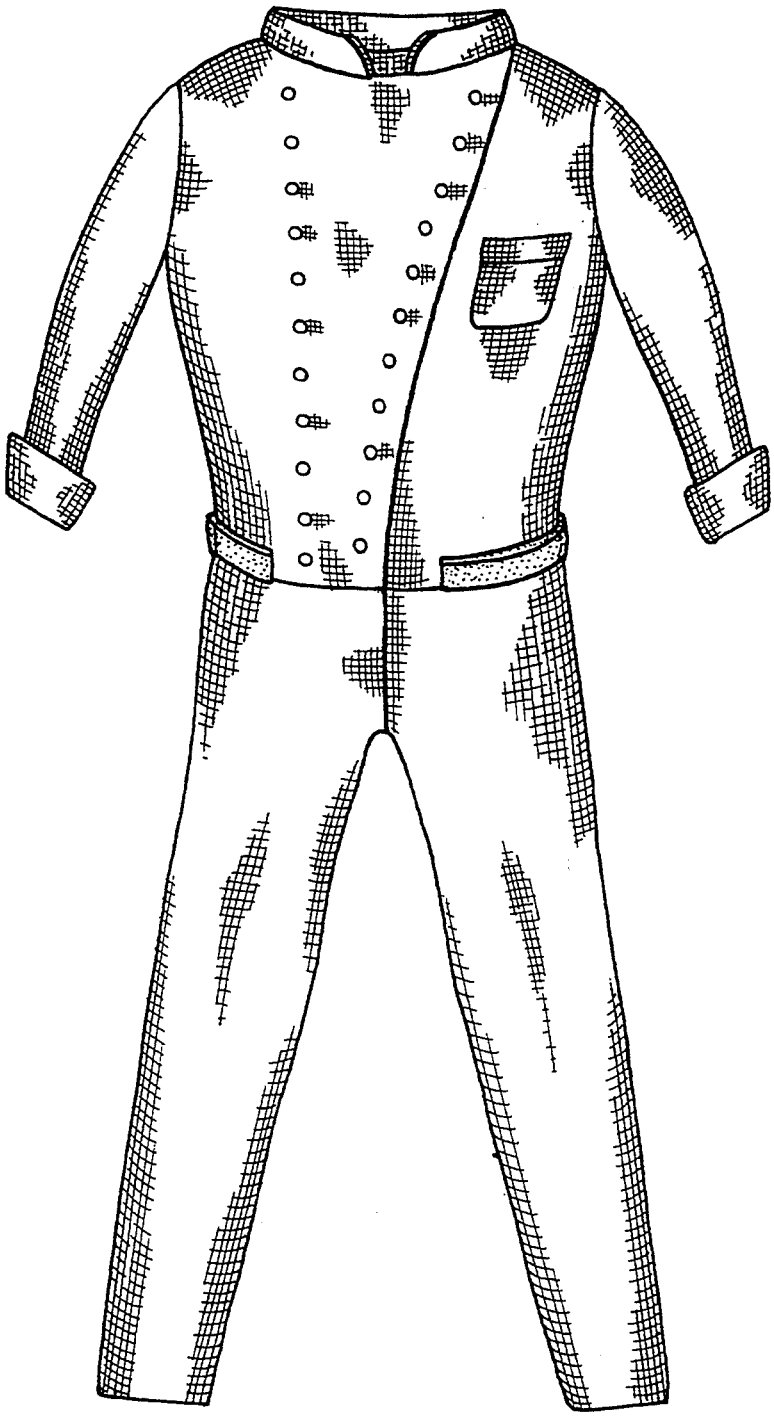
FIG. 9 illustrates a front view of the combination clothing including trousers and jacket.
Figure 10:
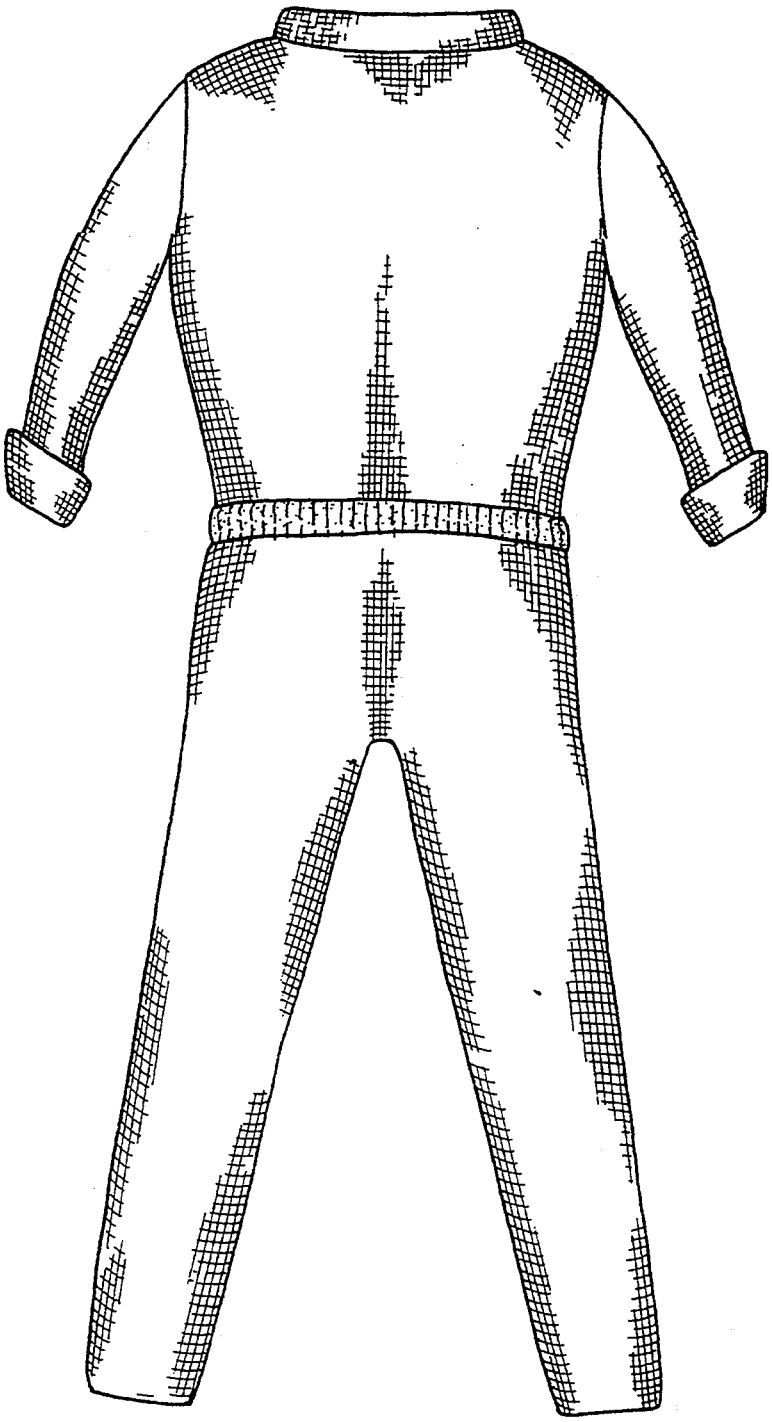
FIG. 10 illustrates a rear view of the combination clothing including trousers and jacket.
Figure 11:
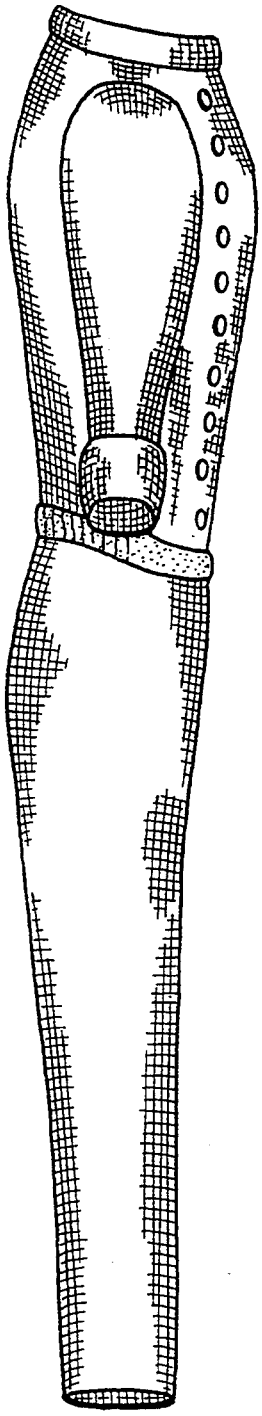
FIG. 11 illustrates a first side view of the combination clothing including trousers and jacket.
Figure 12:
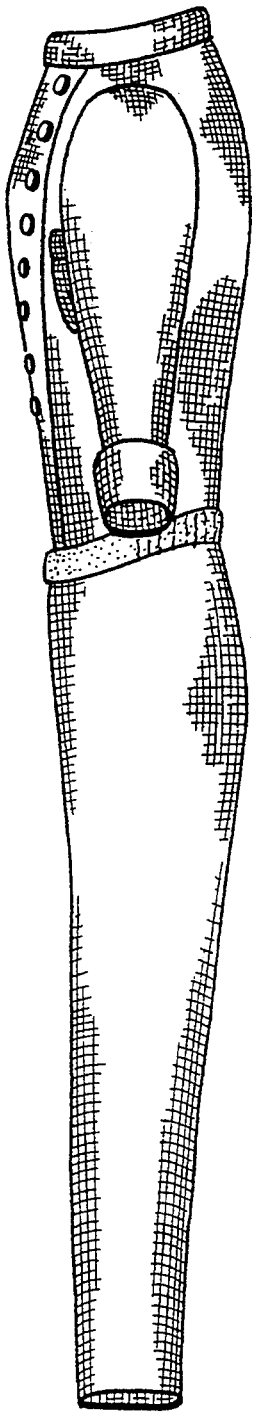
FIG. 12 illustrates a second side view of the combination clothing including trousers and jacket.
Figure 13:
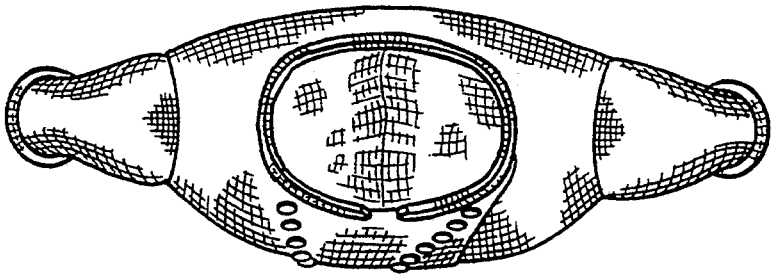
FIG. 13 illustrates a top view of the combination clothing including trousers and jacket.
Figure 14:
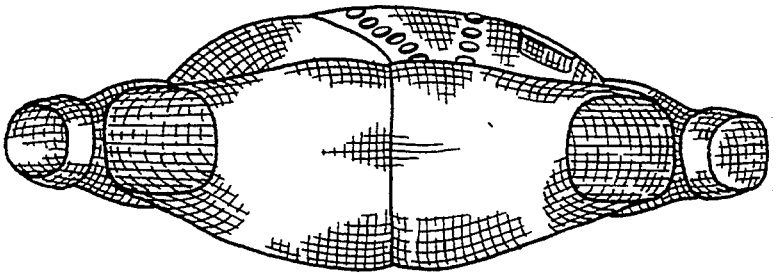
FIG. 14 illustrates a bottom view of the combination clothing including trousers and jacket.
Figure 15:
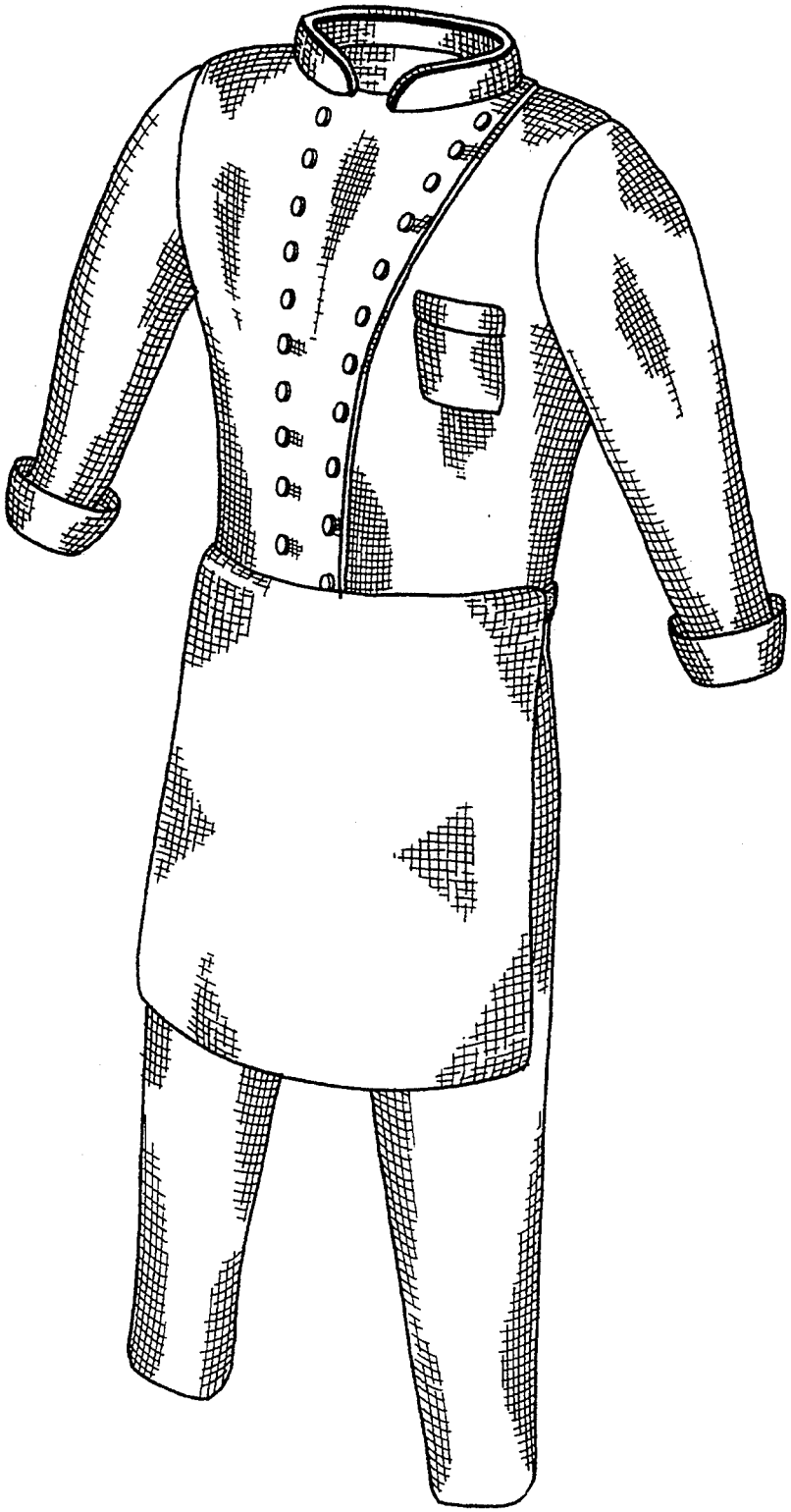
FIG. 15 illustrates an angular front view of the combination clothing including trousers, jacket, and apron.
Figure 16:
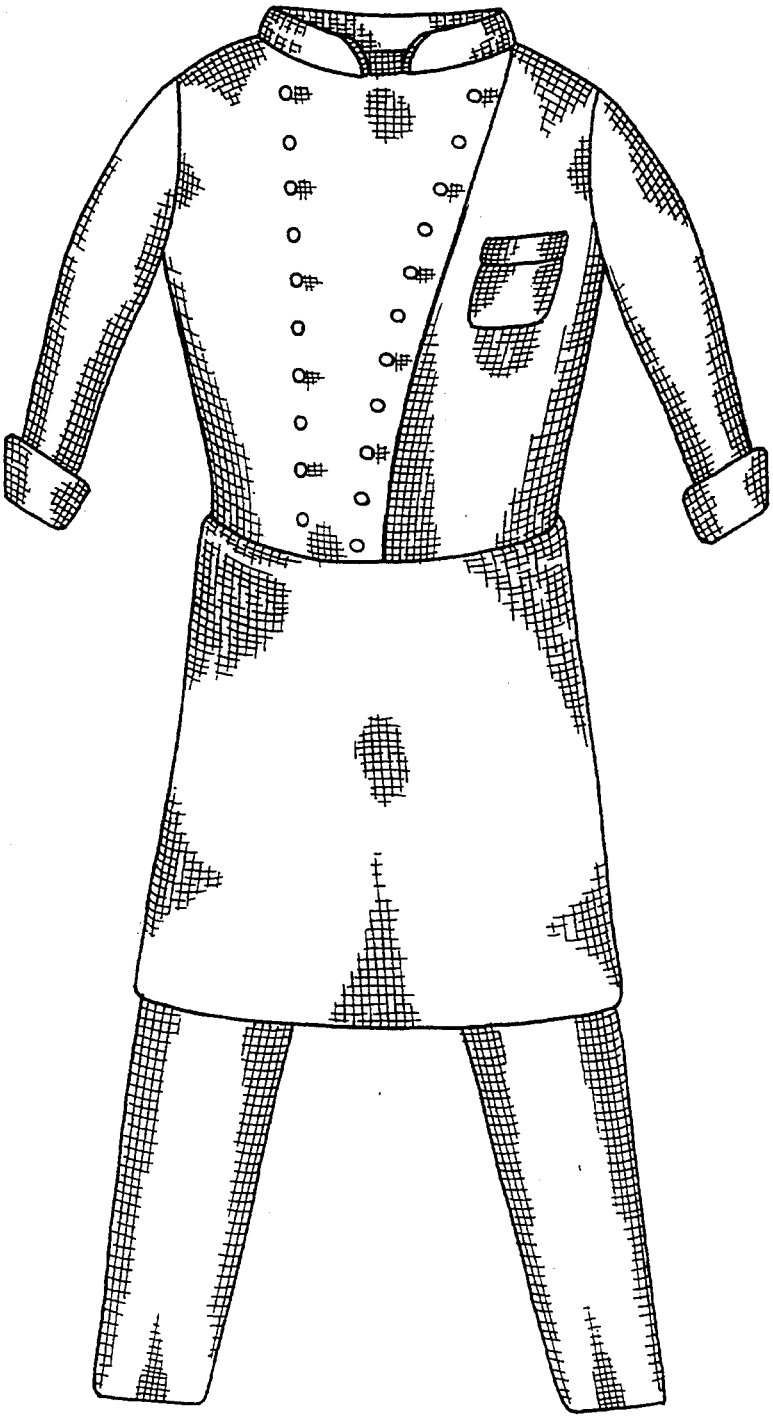
FIG. 16 illustrates a front view of the combination clothing including trousers, jacket, and apron.
Figure 17:
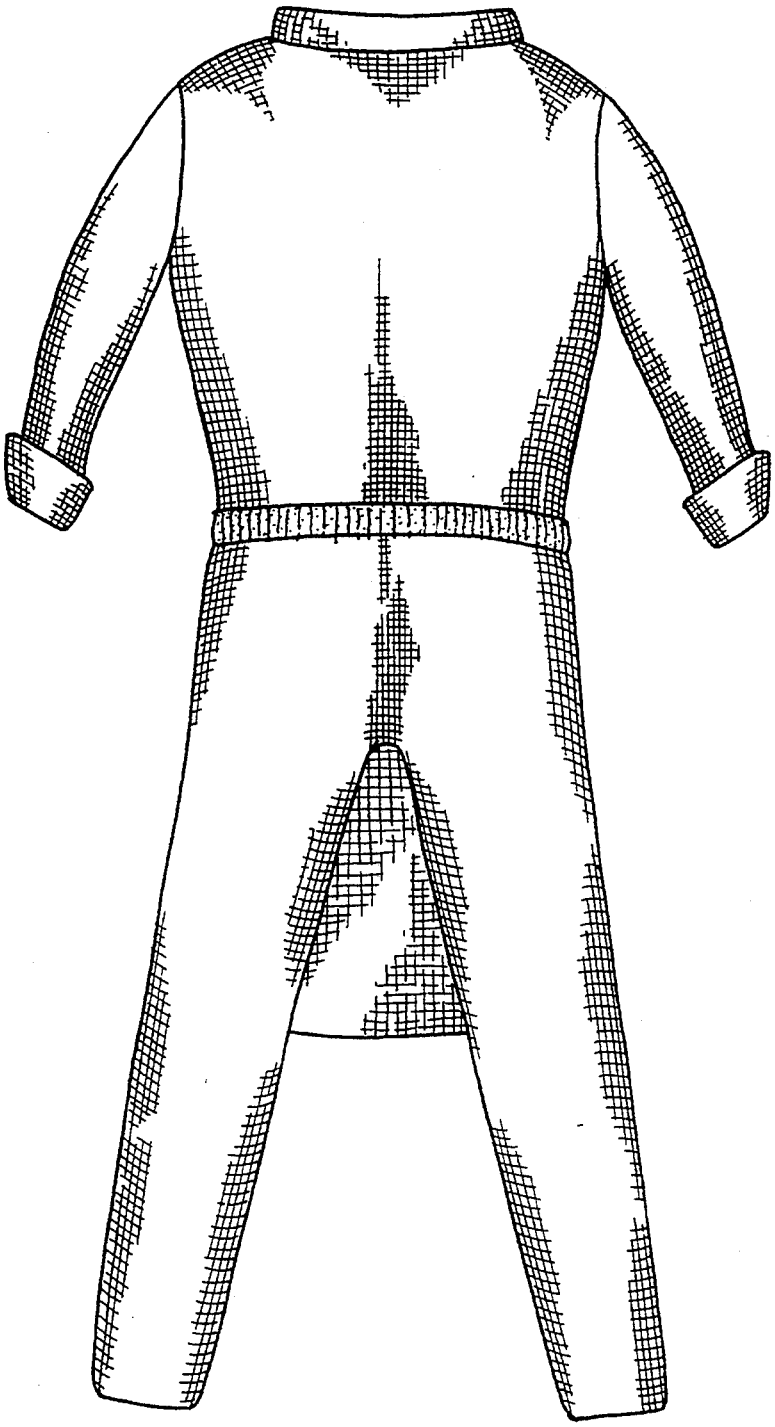
FIG. 17 illustrates a rear view of the combination clothing including trousers, jacket, and apron.
Figure 18:
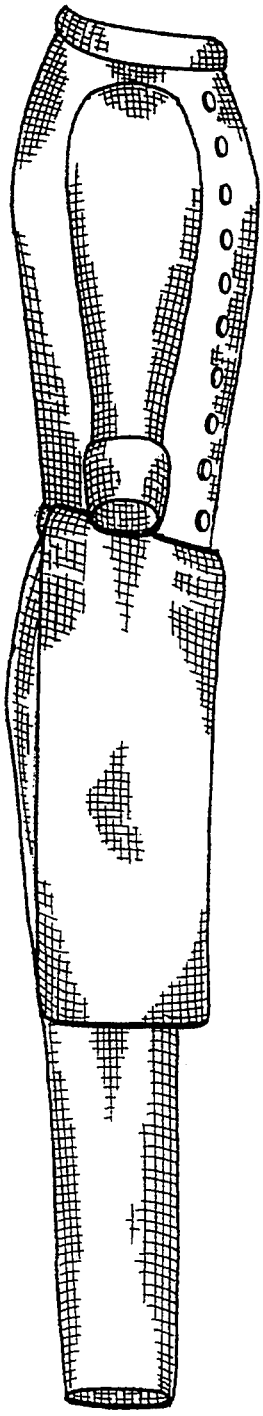
FIG. 18 illustrates a first side view of the combination clothing including trousers, jacket, and apron.
Figure 19:
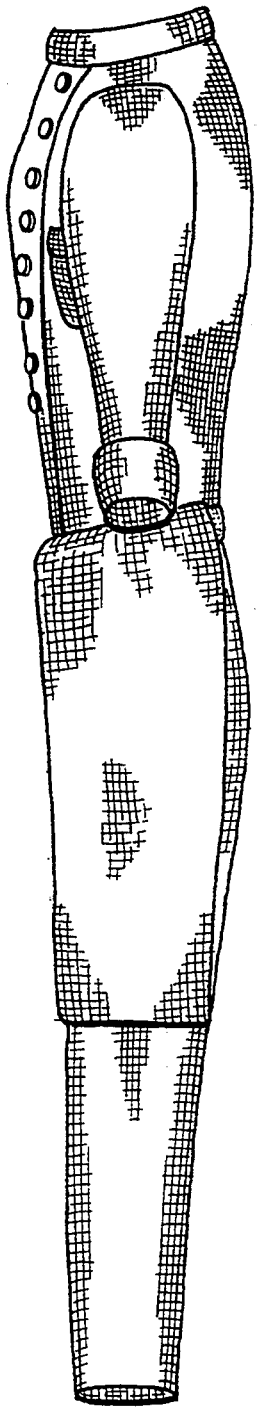
FIG. 19 illustrates a second side view of the combination clothing including trousers, jacket, and apron.
Figure 20:
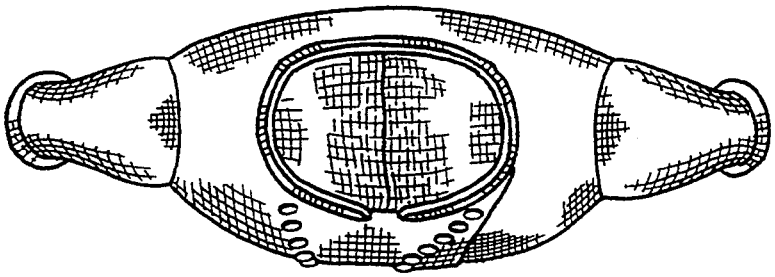
FIG. 20 illustrates a top view of the combination clothing including trousers, jacket, and apron.
Figure 21:
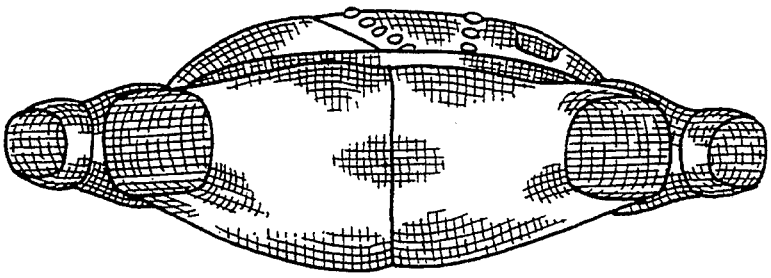
FIG. 21 illustrates a bottom view of the combination clothing including trousers, jacket, and apron.
Figure 22:
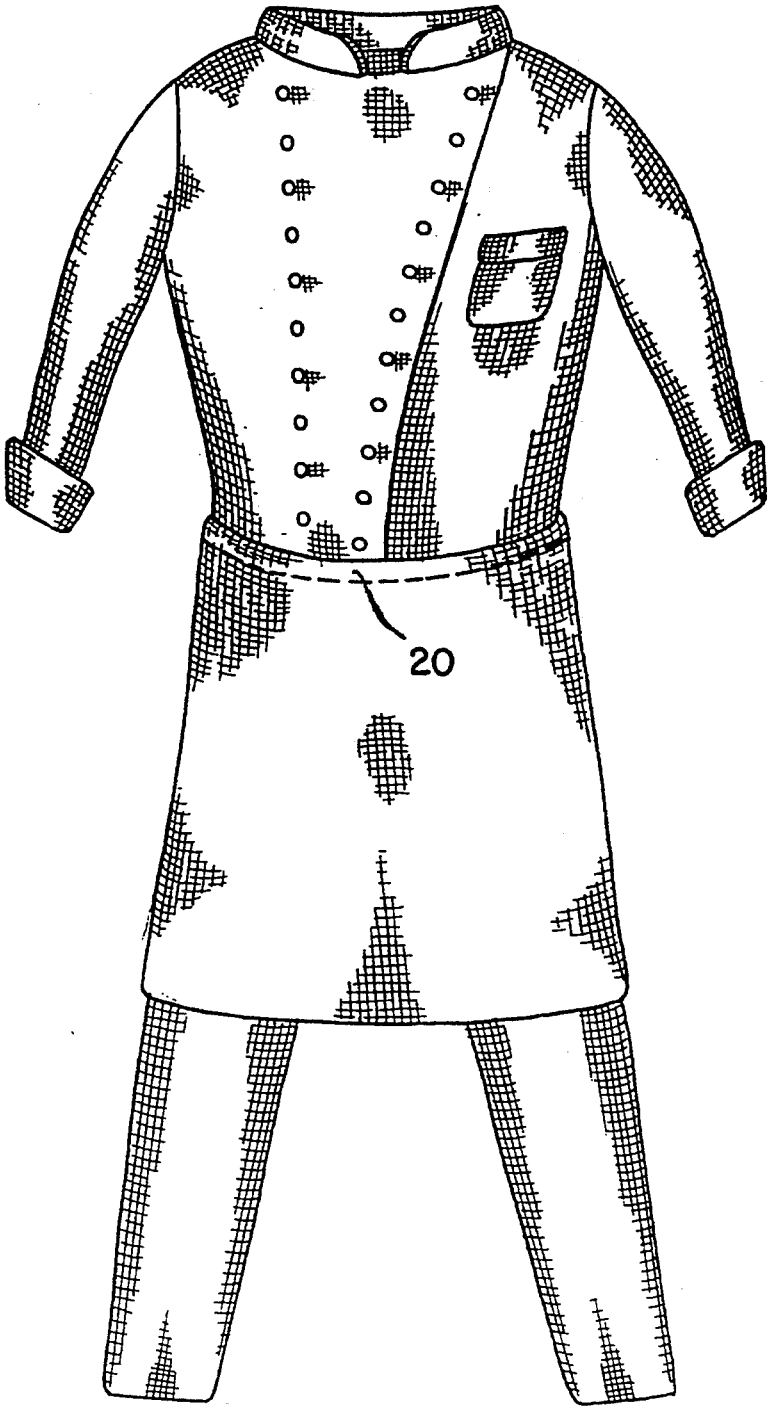
FIG. 22 illustrates an angular front view of the combination clothing including trousers, jacket, and apron and showing the hem.
Figure 23:
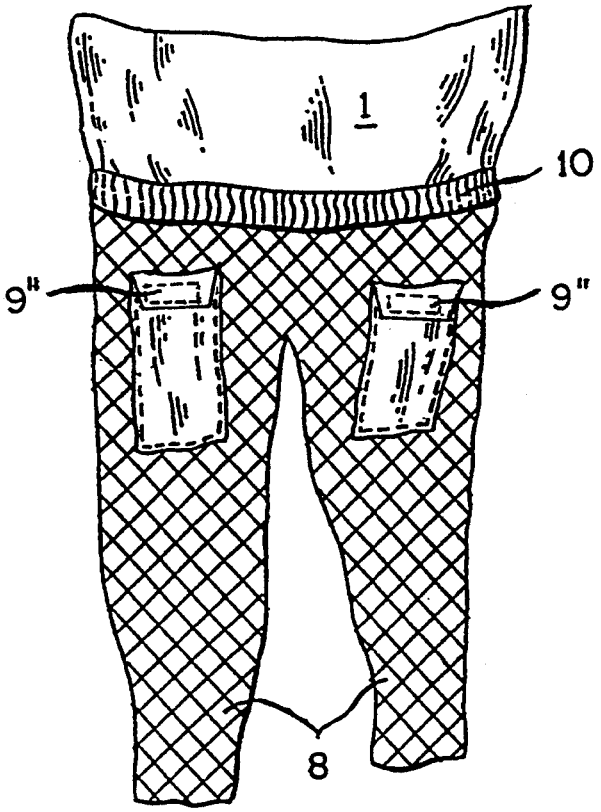
FIG. 23 illustrates a partial rear side view of the jacket and the pair of trousers of FIG. 1 showing that the pockets contain hook and loop fasteners.

The hook and loop fasteners can be provided by Velcro-type strip fastener closures, where the first part of the closure can be provided by a fluffy receiver part and the second part of the closure is provided by a rough hook part, and where the second part engages the first part upon being pressed on said first part. In order to avoid a collecting of lint and threads on the rough part of the closure, as well as to prevent of tangling up during a washing procedure of the invention clothing, a protection flap 30, comprised of a fluffy receiver part, can be sewn onto one longitudinal edge 32 of the rough part 34 of the closure and can be pressed onto the rough part 34 before the washing process, as illustrated in FIG. 7.

When the protection flap 30 is applied to the hook and loop fasteners 9, it is preferably sewn onto the lower longitudinal edge of the part 9 attached to the jacket 1. In this way, if the cook wears an apron, the open protection flap 30 is hidden by the apron 11.

It will be understood that each of the elements described above, or two or more together, may also find a useful application in other types of combination clothing differing from the types described above.

While the invention has been illustrated and described as embodied in the context of combination clothing for cooks, it is not intended to be limited to the details shown, since various modifications and application changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A jump suit comprising a jacket portion having a collar;

a trouser portion having a fly;

a waist band in the area of a waist and sewn onto the jacket portion in an area of the waist;

a zip fastener attached to the trouser portion wherein the zip fastener closes and opens an opening in the trouser portion, and wherein the zip fastener extends from the fly over the waist band of the trouser portion toward the collar of the jacket portion;

hook and loop fasteners disposed at least at two sides, located opposite to each other, at the waist band of the portion;

an apron, wherein the apron includes the hook and loop fastener counter parts disposed in a waist band region, and disposed opposite to the waist band of the trouser portion, on the left and right side of the apron and further comprising a hem wherein the hem is folded upside down to cover the hook and loop fasteners and the hook and loop fastener counter parts disposed on one side of the apron, wherein the hem can be fixed for remaining in a covering position.

2. The jump suit according to claim 1, wherein the jacket portion is white.

3. The jump suit according to claim 1, wherein the hem of the apron is fixable in the covering position at narrow edges located at the apron.

4. The jump suit according to claim 1, wherein the hem of the apron is fixable in the covering position by attachment elements.

5. The jump suit according to claim 1, wherein the hem of the apron is fixed in the covering position by attachment elements furnished at the apron.

6. The jump suit according to claim 5, wherein the hem of the apron is fixed in the covering position by dome snap fasteners at the apron.

7. The jump suit according to claim 1, wherein the trouser portion is furnished with a white/black checker pattern and wherein the jacket portion comprises a white fabric.

8. The jump suit according to claim 1, further comprising a tie knot having a rear side and having its rear side formed of an elastic band, wherein the tie knot is separate and not permanently attached to the jacket portion;

a neck band having two ends and coordinated to the jacket portion but not permanently attached to the jacket portion, wherein the ends of the neck band are pulled through the separate tie knot.

9. The jump suit according to claim 1, wherein the zip fastener is running upwardly in the area of the fly up to about the navel area of the person wearing the jump suit, and wherein the zip fastener is used as a closure to an opening and wherein the zip fastener is running at an angle to from about the navel area to one side of the neck of the person.

10. The jump suit according to claim 9, wherein a chest part of the jacket portion is furnished with a shirt part extending from the zip fastener substantially symmetrical in front of the person covered with a jacket section;

further comprising buttons disposed in two vertical rows and attached to the shirt part and adorning said shirt part.

11. The jump suit according to claim 10, wherein the covering jacket section is lined vertically in the middle and is furnished with slits for the buttons attached to the shirt part, and wherein the buttons engage the slits on the covering jacket section.

12. The jump suit according to claim 1, further comprising pockets formed at the trouser portion, wherein hook and loop fasteners are furnished at the pockets of the trouser portion.

13. Clothing for cooks or other workers, comprising a trouser portion, (8) wherein a first longitudinal edge of a waste band is sewn onto a jacket portion (1), in the area of the waist, wherein a second longitudinal edge of the waste band is sewn onto the trouser portion thereby forming a jump suit, where the trouser portion (8) is furnished with a zip fastener (7), extending from a fly (8') over a waist region of the jump suit toward a collar (3) of the jacket portion (1), wherein the zip fastener closes and opens an opening, and wherein hook and loop fasteners (9) are disposed at least at two sides opposite to each other at the waist band of the jump suit, where an apron (11) is detachably attached at said hook and loop fasteners wherein the apron (11) has the hook and loop fasteners (9') in a waist region of the apron spaced such on two sides of the waist region of the apron (11) as to be disposed opposite to the hook and loop fasteners (9) at the waist band of the trouser portion, and wherein a hem or cuff is furnished in the waist region of the apron, wherein the hem has folding positions, a first folding position for covering the hook and loop fasteners (9') and a second folding position for uncovering the hook and loop fasteners (9') such that the hook and loop fasteners (9') of the apron (11) can engage the hook and loop fasteners (9) of the waist band of the jump suit.

14. Clothing according to claim 13, wherein the hem of the apron (11) is fixable in the folding positions at narrow edges of the hem at the apron.

15. Clothing according to claim 14, wherein the hem of the apron is fixable in the folding positions by attachment elements, in particular dome snap fasteners, at the apron.

16. Clothing according to claim 13, wherein the trouser portion (8) is furnished with a white/black checker pattern and wherein the jacket portion (1) comprises a white fabric.

17. Clothing according to claim 13, wherein a neck band (13) is coordinated to the jacket portion (1) independent of the jacket portion (1), where the ends of the neck band (13) are pulled through a separate tie knot (14), where the rear side of the tie knot (14) is comprised of an elastic band.

18. Clothing according to claim 13, wherein hook and loop fasteners are furnished at the pockets (12) of the trouser portion (8).

19. Clothing according to claim 13, wherein the jacket portion (1) includes a chest part, wherein the chest part is furnished with a shirt part (100), extending from the zip fastener substantially symmetrical in front of the person covered with a jacket section; further comprising buttons disposed in two vertical rows and attached to the shirt part and adorning said shirt part.

* * * * *